US009149911B2

(12) United States Patent
Haverty et al.

(10) Patent No.: US 9,149,911 B2
(45) Date of Patent: Oct. 6, 2015

(54) PROCESSES AND APPARATUS FOR SURFACE MODIFICATION

(75) Inventors: Donncha Haverty, Tipperary (IE); Brendan Kennedy, Kilkenny (IE); Patrick Cheppe, Basse Goulaine (FR); Vincent Olivier Jacquey Desfontaine, Les Sorinieres (FR)

(73) Assignees: HKPB SCIENTIFIC LIMITED, Nenagh, Co. Tipperary (IE); SONATS SAS, Carqauefou (FR)

( * ) Notice: Subject to any disclaimer, the term of this patent is extended or adjusted under 35 U.S.C. 154(b) by 0 days.

(21) Appl. No.: 14/232,072

(22) PCT Filed: Jul. 16, 2012

(86) PCT No.: PCT/EP2012/063933
§ 371 (c)(1),
(2), (4) Date: Mar. 27, 2014

(87) PCT Pub. No.: WO2013/007840
PCT Pub. Date: Jan. 17, 2013

(65) Prior Publication Data

US 2015/0013412 A1 Jan. 15, 2015

(30) Foreign Application Priority Data

Jul. 14, 2011 (GB) ..... 1112111.8

(51) Int. Cl.

| | |
|---|---|
| ***B24C 5/00*** | (2006.01) |
| ***B05D 1/28*** | (2006.01) |
| ***B05D 3/12*** | (2006.01) |
| ***B24C 1/10*** | (2006.01) |
| ***B24C 11/00*** | (2006.01) |
| ***C21D 7/06*** | (2006.01) |

(52) U.S. Cl.
CPC . *B24C 5/005* (2013.01); *B05D 1/28* (2013.01); *B05D 3/12* (2013.01); *B24C 1/10* (2013.01); *B24C 11/00* (2013.01); *C21D 7/06* (2013.01)

(58) Field of Classification Search
CPC ..... B24C 5/005; B24C 1/10; B24C 11/00; B05D 1/28; B05D 3/12; C21D 7/06
USPC ..... 72/53; 623/1.15; 427/2.24
See application file for complete search history.

(56) References Cited

U.S. PATENT DOCUMENTS

| | | | | |
|---|---|---|---|---|
| 3,754,976 | A * | 8/1973 | Babecki et al. | 72/53 |
| 4,224,356 | A * | 9/1980 | Singer | 427/455 |
| 5,829,116 | A * | 11/1998 | Vilon | 29/527.2 |

(Continued)

FOREIGN PATENT DOCUMENTS

| | | | |
|---|---|---|---|
| EP | 0069418 | A1 | 1/1983 |
| EP | 1645338 | A1 | 4/2006 |
| WO | 2009050251 | A2 | 4/2009 |

OTHER PUBLICATIONS

PCT International Search Report, Application No. PCT/EP2012/063933, Jul. 16, 2012.

*Primary Examiner* — David B Jones
(74) *Attorney, Agent, or Firm* — Nydegger & Associates

(57) ABSTRACT

The present application relates to processes for changing the composition of surfaces and the application of such processes. The process involves the introduction of a surface augmentation composition within an aerosol formed from a liquid precursor with bombarding particles in an ultrasonic shot peening apparatus.

18 Claims, 4 Drawing Sheets

(56) References Cited

U.S. PATENT DOCUMENTS

| | | | | |
|---|---|---|---|---|
| 5,950,470 | A * | 9/1999 | Prewo et al. | 72/53 |
| 6,170,308 | B1 * | 1/2001 | Veronesi et al. | 72/53 |
| 6,343,495 | B1 | 2/2002 | Cheppe et al. | |
| 6,508,093 | B2 * | 1/2003 | Berthelet et al. | 72/53 |
| 7,028,378 | B2 * | 4/2006 | Cheppe et al. | 29/90.7 |
| 7,647,801 | B2 * | 1/2010 | Cheppe et al. | 72/53 |
| 7,673,486 | B2 * | 3/2010 | Bayer et al. | 72/53 |
| 2010/1211158 | * | 5/2010 | Haverty et al. | 623/1.15 |

* cited by examiner

PROCESSES AND APPARATUS FOR SURFACE MODIFICATION

FIELD OF THE APPLICATION

The present application relates to processes for changing the composition of surfaces and the application of such processes.

BACKGROUND

Shot peening is a process whereby the physical nature of an existing device surface may be modified. In shot peening, solid particulate is propelled at high velocity by means of a carrier fluid either wet or dry, typically water and air respectively, so as to impact the surface of a target substrate typically a metallic substrate.

Shot peening has long since been established as a method to induce desirable stress properties in the surfaces of metallic devices wherein the impinging particles act as peening hammers causing a local plastic deformation at the surface rendering it less prone to cracking and corrosion. In addition to the significant pressures, large amounts of thermal energy, instantaneous temperatures as high as 1000° C. have been reported, are also generated locally at the surface in the vicinity of the impact. The limitation of shot peening processes involving the use of fluid streams to propel the shot particles to surfaces is that while shot may be recovered, large amounts of shot are required in the process itself. This places practical cost limitations on the quality of shot that can be used and a proportion of the shot used is consequently of irregular shape. The action of such irregular shot particles on surfaces can be abrasive in nature resulting in a degraded surface finish.

In addition shot peening nozzles are generally configured orthogonal to the surface so that the shot strikes the surface at a constant angle of incidence of close to 90°. As a result the resulting shot peened substrate surfaces are typically dimpled and uneven in texture.

Ultrasonic shot peening (Cheppe and Duchazeaubeneix, U.S. Pat. No. 6,343,495) has been developed as a means to circumvent these limitations. In this process shot is projected to the surface by means of a sonotrode. A sonotrode is a device that oscillates at ultrasonic frequencies and which impels the shot to the substrate surface. The sonotrode can be located in the bottom of a chamber such as a metal bowl. The rim of the bowl may contact the surface to be peened or the surface may form a wall or walls of a chamber that encloses the piece to be shot peened. This confinement of the shot means that much less shot is required as individual shot can repeatedly peen the work piece given that shot will continually rebound from the work piece and chamber walls back to the sonotrode from which it is again impelled to the work piece surface. The requirement for lower quantities of shot means that shot of higher material and geometry quality may be selected and a superior surface finish obtained. Additionally the random direction from which the shot impacts a work piece results in a surface less dimpled and less uneven in nature. Ultrasonic shot peening has largely been used for specialist applications and in particular for the work hardening of materials in the aerospace sector including for example turbine blades.

Shot peening and abrasive processes have been used extensively in surface science as a means to clean and condition surfaces in preparation for further treatments. A shot peening process is known for the simultaneous cleaning and painting of substrates (Kik and Schuurink—U.S. Pat. No. 4,517,248). The advantage being that the delay between cleaning and painting is eliminated minimizing re-oxidation of the cleaned metal surface prior to application of the paint. Gruss and Shapiro (U.S. Pat. No. 4,634,603) describe a process for the coating of printed circuit boards in which shot peening is employed to clean and condition the surface in preparation for subsequent coatings. A number of techniques have been disclosed which use shot peening or abrasive processes as a means to modify the surface chemistry/composition of metallic and other substrates by embedding desired solid material in the surface and these techniques may be broken into three distinct methodologies.

In a first methodology, a single type of single-phase solid particulate is used as the peening or abrasive media. In this method the shattered pieces of the particulate become embedded in the surface of the metal on impact. Such processes are mostly used to embed ceramic materials into a surface as the particles must have sufficient hardness size and mass to abrade or peen the surface. Examples include silica, alumina or calcium phosphate ceramics among others as, for example, disclosed in Arola and McCain (U.S. Pat. No. 6,502,442) and that of Kuo (U.S. Pat. No. 5,441,763).

The second methodology also involves the use of a single type of solid particle as the peening or abrasive media but the particles themselves are comprised of multiple components usually a hard component that gives the particle mass and density and a softer component that is desired to embed in or attach to the surface on impact. Examples are to be found in (Muller and Berger—US2004/158330; Bru—Maginez et al. U.S. Pat. No. 6,431,958; Hisada and Kihira U.S. Pat. No. 6,726,953; Omori and Kieffer—U.S. Pat. No. 6,015,586) and in the Rocatek™ bonding system for dental implants provided by 3M ESPE.

The third methodology is to employ a mix of different types of solid particulate media, a primary abrasive or peening material and a secondary material desired to embed or augment the surface in the same fluid stream so that they impinge the surface simultaneously. Examples of this process may be found in (Babecki and Haehner—U.S. Pat. No. 3,754,976; Chu and Staugaitis U.S. Pat. No. 4,552,784; Spears—U.S. Pat. No. 4,753,094; Vose—US20060089270; O'Donoghue. et al.—WO2008033867, O'Donoghue et al—US WO2009112945, where such processes are claimed to modify the surface composition of a variety of substrates with a number of materials including plastics, ceramics and metals. WO/2008/033867 teaches the use of grit blasting for the impregnation of metal oxide layers with solid particles delivered to the surface during a standard grit blasting treatment, the disruption caused to the surface oxide by the abrasive action allowing the smaller/softer solid particulate to become entrained in the oxide as it reforms.

Recently a fourth methodology for augmenting the surface of substrates, as detailed by Haverty and Kennedy—WO/2009/050251 (, has been described. This method involves atomising a liquid based precursor coating composition to form an aerosol, which is directed to the surface of the substrate in conjunction with a stream of hard, solid particles carried to the surface in a gas that may be of irregular shape (grit) but are more preferably of regular spherical shape (shot). In this process the collision energy released by the impacting shot mediates the transformation of the precursor composition into a well-adhered coating. This process solves problems associated with the prior art because the species augmenting the surface chemistry is not restricted to solid materials alone, the flow of augmenting species to the surface can be controlled precisely and those materials such as polymers particles that are typically prepared as colloidal suspensions can be used in the process. Both of these technologies suffer from the same limitation of regular shot peening processes with respect to quantities of shot used and consequently there exists the need for an improved process.

SUMMARY

The present application provides for the inclusion of an antecedent coating material from a liquid precursor within an ultrasonic shot peening process.

BRIEF DESCRIPTION OF THE DRAWINGS

The application will now be explained with reference to the following description and the accompanying drawings, in which.

DETAILED DESCRIPTION

Figure 1:
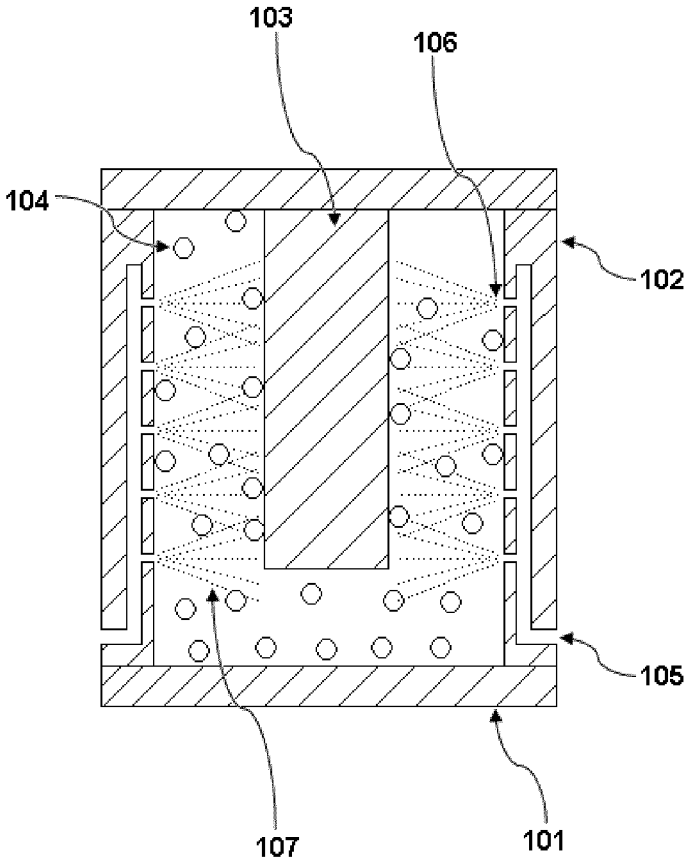
FIG. 1 is a schema of a device for ultrasonic shot peen coating a work piece that is enclosed or partially enclosed within a chamber at least one wall of which forms a sonotrode and wherein an aerosol generator is furnished for providing an aerosol at the surface of the work piece.

Ultrasonic shot peening is known to induce desirable strain characteristics and or topographies (surface roughness) in metallic surfaces wherein particles of sufficient size, density and velocity impacting the surface cause a local plastic deformation that enhances the mechanical properties of the surface rendering it less vulnerable to stress cracking and corrosion. However the impact of bombarding particles also generates large pressures and thermal energies locally at the impact sites on a surface. Although this energy is dissipated rapidly, the heat and pressure generated by such impacts provides a potential mechanism to facilitate the reaction of a range of desirable species at surfaces during such processes.

The present application describes a modified ultrasonic shot peening process that harnesses the transient heat and pressure generated during the bombardment of a surface with sufficiently energetic bombarding particles. Suitably, the bombarding particles are propelled by a sonotrode. The process is directed at utilizing this bombarding particle energy to facilitate surface augmentation and coating of the surface in a controlled, safe and effective manner. In particular, a surface or work piece to be coated is enclosed or at least partially enclosed by or in the chamber of an apparatus. An internal surface of the chamber is employed to impart energy to the particles, e.g. suitably one wall of the chamber comprises a sonotrode. A sonotrode is a device that vibrates at ultrasonic frequencies. The sonotrode serves to impel bombardment particles to impinge the surface to be coated. The chamber is suitably enclosed to confine shot within the chamber. This confinement of the shot means that individual shot can repeatedly peen the work piece given that shot will continually rebound from the work piece and apparatus walls back to the sonotrode from which it is again impelled to the work piece surface.

The present application employs the concomitant provision of antecedent materials of a coating, i.e. surface augmentation material, into the chamber. By providing, antecedent materials of the coating at the surface to be coated, an adhered coating is formed by transformation of the coating materials into a coating by the action of the bombarding particles. Advantageously, the antecedent material may comprise one or more active agents (such as therapeutic drugs and proteins by way of example) and the process is particularly suited to the adherence of active coatings to surfaces.

The antecedent material may comprise a variety of ingredients including particulate, dispersions, sols, gels and\or resins. These antecedent materials of the coating may be provided at or proximal to the work piece surface as an aerosol, generated by the atomisation of a liquid precursor and/or the fluidisation of particulate precursors. In another configuration of the application such antecedent materials may be provided at or proximal to the surface as the bombarding particles or as a component of the bombarding particles. In another configuration of the application the antecedent materials may comprise materials deposited on the surface prior to the bombarding particles impinging the surface.

One configuration of the application is illustrated in FIG. 1. The sonotrode, 101, and the walls of the chamber, 102, are arranged so that they form a chamber that encloses or partially encloses the work piece, 103. The sonotrode is mechanically vibrated at ultrasonic frequencies so that the bombarding particles, 104, are impelled at speed in order that they impact the walls of the chamber and the work piece provided within the chamber. One or more inlet apertures are defined in an interior surface of the chamber, for example as one or more nozzles 106 provided in a chamber wall. The nozzles may be used to introduce the coating precursor materials, which is suitably a liquid precursor. The precursor materials in turn may be fed from a suitable reservoir (not shown) in fluid communication with the inlet apertures, for example by means of tubes 105. Using tubes 105 which are connected to a nozzle or nozzles, 106 to an aerosol, 107, of the precursor composition is directed toward the surface of the work piece.

The use of multiple nozzles is advantageous to ensure an even distribution of the coating materials to the entirety of the work piece surface, which in turn is formed into a coating by the co-operative action of the bombarding particles on the coating precursor materials. The nozzle(s) and ancillary equipment may be constructed so that they flush with, recessed in or protrude from the wall of a chamber. In one arrangement the wall of the chamber in which the nozzles are provided is different to the one wall comprising the sonotrode. In the context of the present application, it will be understood that the term wall is intended to include side, top and bottom surfaces of a chamber.

Figure 2:
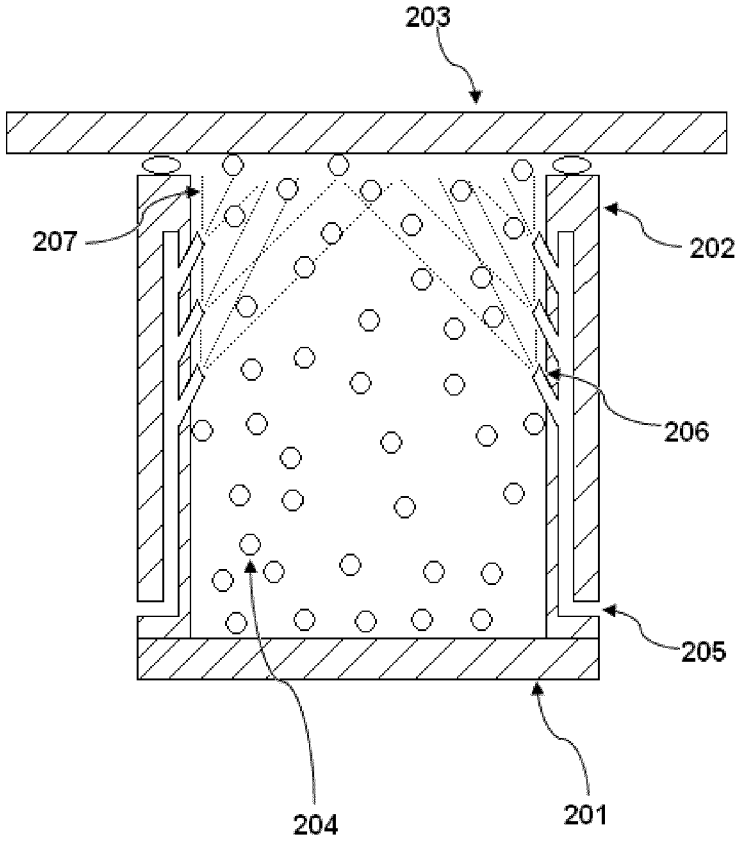
FIG. 2 is a schema of a device for ultrasonic shot peen coating a work piece wherein a sonotrode forms at least one wall of a bowl that directly abuts the surface of a work piece and wherein an aerosol generator provides an aerosol at the surface of the work piece.

Another configuration of the application is illustrated in FIG. 2. The sonotrode, 201, and the walls of the bowl, 202, are arranged so that they form a bowl that is abutted directly against the work piece, 203. The sonotrode is mechanically vibrated at ultrasonic frequencies so that the bombarding particles, 204, are impelled at speed in order that they impact the walls of the bowl and the work piece. As with the first arrangement, a liquid precursor and optionally particulate precursor is concomitantly fed into tubes, 205, connected to a nozzle or nozzles, 206, so that an aerosol, 207, of the precursor composition is directed to the surface of the work piece. The nozzle(s) and ancillary equipment may be constructed so that they are embedded in the wall(s) of the bowl or alternatively protrude into the bowl.

Exemplary nozzle systems for generating the aerosol from liquid precursors include those that direct a gas stream over a venturi connected to a liquid reservoir atomizing by the Bernouli effect. Another possible nozzle configuration is one where a liquid stream is ejected from a nozzle and atomised by gas jets either side of the liquid stream. Pre-filming nozzles whereby a capillary deposits a thin film of liquid at a standard nozzle tip may be utilised to generate small droplets (Nguyen and Rhodes, 1998).

In one arrangement, ultrasonics may be used to provide dual advantage in the by incorporating the nozzle delivering the antecedent composition into a sonotrode(s) such that the ultrasonic vibration of the sonotrode(s) aides atomisation of the antecedent composition in addition to imparting momentum to the shot. The chamber may incorporate multiple sonotrodes operating at different frequencies depending on their primary function: atomisation or fluidisation of the shot.

Yet another type of nozzle that may be employed is one of the type whereby a gas lens is used to focus a liquid stream for the creation of small droplets (Ganan-Calvo U.S. Pat. No. 6,174,469). In all of the described arrangement, an internal mixer may precede the nozzles in the fluid path from the reservoir. In such an internal mixer (Nguyen and Rhodes, 1998), the liquid may be atomised prior to being expelled from the nozzle so as to decrease the droplet size. The content of each of these disclosures is hereby incorporated by reference.

Nozzle systems for delivering particulate precursors to the surface may be simple venturis such as standard grit blasting and shot peening nozzles. Co-axial nozzles might also be used to deliver particulate to the work piece surface and such co-axial nozzles might also be used to carry particulate precursors and atomise a liquid precursor simultaneously. Ultrasonics might also be incorporated into the design of such nozzles.

Figure 3:
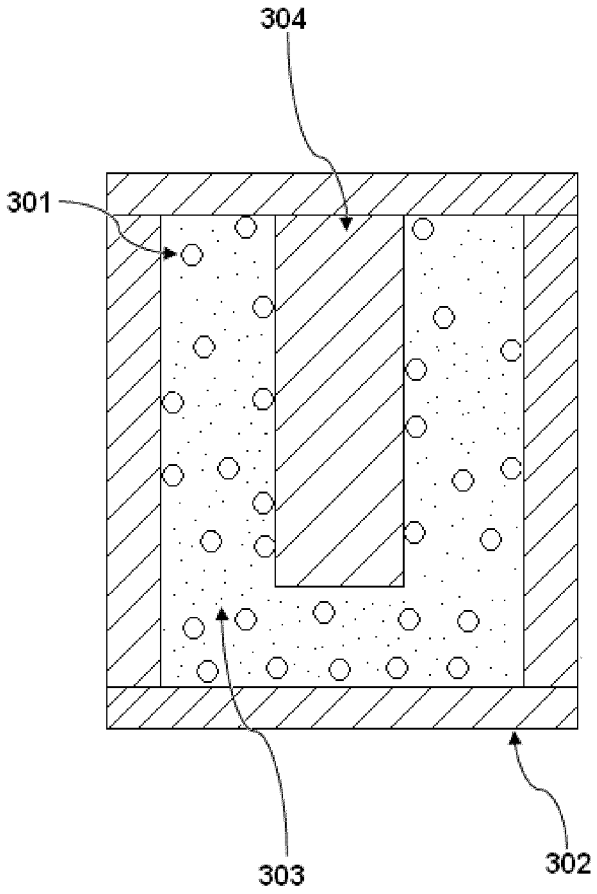
FIG. 3 is a schema of a device for ultrasonic shot peen coating a work piece wherein a sonotrode forms at least one wall of a bowl that directly abuts the surface of a work piece and wherein an aerosol generator provides an aerosol at the surface of the work piece.

In an alternative arrangement of this application shown in FIG. 3 the liquid antecedent composition or the particulate precursors of the coating materials is introduced into a chamber prior to the coating process. The antecedent composition is atomised by the vibratory action of a sonotrode or sonotrodes that constitute a wall or walls of the chamber concomitant with the fluidisation of the bombarding particles, 301. Thus the sonotrode(s), 302, serves to both impel the bombarding particles to and provide the aerosol of the precursor composition, 303, at, the surface of the work piece, 304. This configuration is advantageous in that the requirement for nozzles to deliver the precursor composition to the work piece surface is obviated simplifying the processing equipment and process considerably. However, the effectiveness of this arrangement may depend on a number of factors including the complexity of the shape of the work piece and the nature of the coating precursor materials.

The present application has use in areas of application including the provision of active coatings for medical devices and biocidal coatings for surfaces generally. Currently, such active coatings are utilized extensively in the medical implant sector wherein active agents such as by way of example anti-restentosis agents or bone morphogenic proteins are adsorbed onto a suitable carrier matrix (typically a polymer or calcium phosphate ceramic) coated on the surface of an implantable medical device. Once implanted, the agents are released from the coating. The agents may serve a variety of biological functions including for example: reduction of smooth muscle cell proliferation or the promotion of osteointegration where the active agents are anti-restentosis agents or bone morphogenic proteins for example and incorporated into coatings used in the drug eluting cardiovascular stent and hard-tissue implants respectively. However the coating methodologies traditionally used in such applications are multistep processes employing chemical and thermal treatments to adhere suitable carrier matrices to the implant surfaces. In a subsequent step, the carrier matrices are subsequently loaded with the active agent in a separate, usually adsorption step. In contrast, the present application allows the generation of active coatings at a range of surfaces in a single step process with optimal distribution of the active agent in the coating.

In the present application the energy that facilitates the reaction of the antecedent materials into an adhered coating at the surface is provided by particles impacting the surface. Dynamic compaction is a process that involves the use of an accelerated piston impacting a compact of particulate inorganic material; the pressure and heat generated from the shock wave propagating through the material acting to sinter the particles together (Stuivinga et al., U.S. Pat. No. 6,403,210). The present method may be regarded as being analogous to dynamic compaction in the sense that the energy being harnessed is kinetic in origin. However in the present application the energy originates from the impact of particles (as opposed to the single large mass, the piston, in dynamic compaction) and may be readily controlled and tailored by varying the properties of the particles themselves as well as the velocity and density with which they impact the surface.

In order for the antecedent materials to be transformed into a coating sufficient energy must be dissipated at the surface for reaction. This is primarily determined by the mass and velocity of impacting particles i.e their kinetic energy. In the present application a distinction is made between different types of particles on the basis of the function they perform at the surface:

1. Bombarding particles are those particles that strike the surface and dissipate sufficient energy to facilitate reaction of antecedent materials of the coating and may be of ceramic, polymer, metal or compositions thereof. Typically these particles will be of micron or greater dimension, suitably between 0.1 and 10 mm, and may comprise such materials as silica, alumina, zirconia, titanates, titanium oxide, diamond, silicon carbide, boron carbide, tungsten carbide, calcium phosphate ceramics, calcium carbonate, metallic shot, metallic wires, carbon fiber composites, hard polymers, polymeric composites, titanium, stainless steel, hardened steel and nickel or chromium alloys among others by way of example.

2. Composite bombarding particles comprise an outer layer of antecedent material on a core bombarding particle and serve a dual function: they also strike the surface and dissipate sufficient energy to facilitate reaction of the antecedent materials but in addition provide antecedent material at the surface for reaction by the mechanisms outlined above.

3. Antecedent particles comprise particulate matter that is incorporated into the coating, typically delivered to the surface with insufficient energy to generate any significant pressure or heat examples include low-density materials such as polymers.

Composite bombarding particles have previously been disclosed in the prior art including particles comprising a core of hard material and an outer layer that may be ceramic or polymeric in nature. On impact the interface between the outer layer and the core particle is broken, the outer material becoming available for reaction by the mechanisms outlined above. Previously disclosed composite particles comprise outer layer materials that include titanium dioxide, silica, and a range of polymer materials (Muller and Berger, Bru-Maginez et al., Hisada and Kihira; Omori and Kieffer, all of which have been referenced above and incorporated herein by reference. Another example is those materials provided for the Rocatek™ bonding system. Other exemplary outer layer materials may include calcium phosphates, zirconia, calcium phosphate glasses and polymer resins by way of example. These outer layers may further be augmented with active agents.

Figure 4:
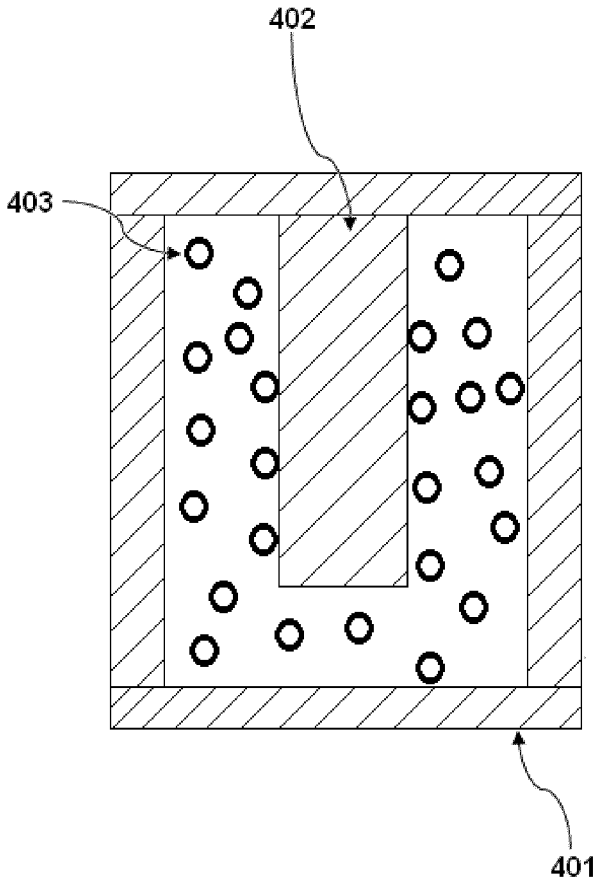
FIG. 4 is a schema of a device for ultrasonic shot peen coating a work piece wherein a sonotrode forms at least one wall of a bowl that directly abuts the surface of a work piece and wherein a means is furnished for providing the antecedent materials of the coating as a lamellar layer on the shot particles.

Another configuration of this application is shown in FIG. 4. In this configuration the antecedent composition of the coating materials is delivered by a sonotrode, 401, to the surface of the work piece, 402, as the outer coating of composite bombarding particles, 403. Upon impinging the work piece the outer shell of the composite bombarding particle is coated onto the substrate surface. Such a configuration can also be used wherein the sonotrode forms part of a bowl.

The use of ultrasonic shot peening in the present application to impel the bombarding particles to the surface of the substrate is advantageous for a number of reasons. The low quantity of bombarding particles needed to perform a typical ultrasonic shot peening process means that high quality shot particles can be used with little or no cost implications resulting in a superior coating finish. This contributes to a higher degree of process control and repeatability. The selection of higher quality shot also reduces the potential for surface contamination. However lower quality shot or grit may be used for certain applications as is deemed appropriate. Complex geometries, not readily shot peened using conventional techniques, may also be treated using ultrasonic shot peening and the coating finish is superior due to the random directions at which shot impinges the substrate surface. Another notable advantage of ultrasonic shot peening is that the chamber or bowl used to confine the bombarding particles may be tailored to different products and parts allowing the controlled coating of only those surface sections on which a coating is desirable. This is particularly attractive for the coating of orthopedic implants such as hip stems where it is desired only to coat a specific area of the hip stem surface.

In the configurations of the present application, the bombarding of particles is combined with the use of an aerosol. The cooperation of the bombarding particles and an aerosol generated from the atomization of a liquid precursor is advantageous for a number of reasons:

1. Many desirable materials not readily available in particulate form may be delivered to the surface within the aerosol and formed into coatings including precursor dispersions, sols, gels, resins and suspensions of a vast array of polymer, ceramic and metallic materials.

2. The use of a liquid phase prevents excessive heat generation that would result in the deformation of thin metal substrates such as stents, catheters and the thin metallic casings used in various medical devices or in the degradation of active agents.

3. The liquid phase of the aerosol acts to trap particles that are not adhered to the substrate surface preventing the generation of harmful clouds of particulate matter that may constitute a health hazard.

4. A large amount of flexibility is manifest in the choice of aerosol solvent employed, the solvent may be chosen to suit the particular chemistry of the material being attached to the surface particularly the physico-chemical characteristics of antecedent materials being presented at the surface, (i.e. as solute, suspended particle, gel, resin or sol) is determined primarily by the solubility of the antecedent component in a solvent.

Controlling the size and density of droplets in aerosols generated from liquid precursors is of particular significance in optimising the conversion of antecedent materials into a coating at the surface. Many types of atomizer may be used for the present application. The gas to liquid ratio and flow rates can be controlled in most two-fluid atomizers and those skilled in the art will be aware of the effect of such parameters as venturi design, gas pressures, liquid properties, liquid flow rates and the like on the density and size of droplets produced by such atomizers. Ultrasonic atomizers may also be useful in reducing droplet size. Similarly, the use of volatile organic solvents, hydrocarbons for example, in the liquid phase may be employed. Control over the composition of the coating may be exercised by varying the concentration of solute, suspended particles or precursors in the atomised liquid phase. This is desirable when costly pharmaceutical agents are to be part of the coating.

In addition the process may be performed in a controlled environment such as in a chamber or cabinet isolated from the general surroundings. In certain applications it may be advantageous that such environs approximate a clean room environment, particularly where the surface being coated is for use in a medical setting. Those skilled in the art will be aware of how components such as air-filters, hepa-filters, ultraviolet sterilizers, other sterilization equipment and the like may be incorporated into such chambers or cabinets.

It may also be advantageous that such cabinets or chambers be connected to pumping systems to remove the byproducts of the process, blasting particles, liquid and the like, and deliver them to suitable waste storage vessels. Such environments may also incorporate temperature control and those skilled in the art will appreciate how the relationship between the temperature of the environment and the liquid phase employed in atomization may influence drop-size in the aerosol being provided at the surface.

A further feature of the present technique is that the environment at the surface may be controlled by careful selection of the gases for the aerosol and the gases present in the coating apparatus. In particular, the gases employed in the present application may be used to induce desirable properties in the surface in addition to delivering the particles and aerosol, particularly where the surface being coated is metallic. This is achieved by employing gases that are substantially free of oxygen as the gas in the chamber/bowl and/or as an atomizing gas. The gas may react with the surface to create a passive layer of metal salts. Where the gas is nitrogenous and reducing in nature (e.g. of nitrogen) the metal surface may be nitrided. Where the gas is carbonaceous and reducing in nature (e.g. of carbon monoxide in an inert gas such as argon) the metal surface may be carburized. Where the gas is a mixture of nitrogenous and carbonaceous gases (e.g. of carbon monoxide and nitrogen in argon) the metal surface is carbonitrided. Thus metal surfaces may be coated while the underlying metal is simultaneously hardened and\or passivated.

The technique of the present application may be used to form a vast array of polymeric, inorganic and metallic species into coatings at surfaces that may advantageously be augmented with or incorporate active agents of varying types, providing an adhered active coating on a surface, where the coating incorporates a carrier matrix and an active agent. The active agent may be bonded to or adsorbed on a component of the carrier matrix or simply be entrained within it. The carrier matrix may be of ceramic, glass, metal, polymer or combinations thereof. In addition the polymers may be biocompatible, antibacterial or naturally occurring biopolymers. In certain applications it would be desirable that the ceramic, metal or glass be biocompatible.

It will be appreciated that a wide variety of polymer materials may be employed as part of or indeed as the antecedent material to form the coating. Exemplary antecedent polymer materials may include particulate, solutions, gels, sols and resins of Acrylics, poly(acrylic acid), Poly(acrylic acid, sodium salt), poly(methylmethacrylate) (PMMA), poly(methylacrylate) (PMA), poly(hydroxyethyl methacrylate) (HEMA), poly(acrylonitrile), acrylonitrile (PBAN), Sodium polyacrylate, polyacrylamide (PAM), Ethylene N-Butyl Acrylate, Polyethyleneglycol methyl ether methacrylate, Poly(acrylic acid) partial sodium salt-graft-poly(ethylene oxide), Poly(acrylic acid-co-maleic acid), Poly(acrylonitrile-co-butadiene-co-acrylic acid)dicarboxy terminated, Poly (acrylonitrile-co-butadiene-co-acrylic acid), dicarboxy terminated glycidyl methacrylate diester, Poly/ethylene-co-acrylic acid), Poly(ethylene-co-methyl acrylate-co-acrylic acid), Poly(2-ethylacrylic acid), Poly/2-propylacrylic acid), Poly(propylene glycol) methacrylate, Poly(propylene glycol) methyl ether acrylate, Poly(propylene glycol) 4-nonylphenyl ether acrylate, Poly(acrylic acid-co-acrylamide) potassium salt, Poly(N-isopropylacrylamide), Poly(acrylamide-co-acrylic acid), Acrylic Copolymers, any other polyarylate; polycarbonates, polycarbonate, polyestercarbonate; polyvinyls, polyvinyl ethers), Poly(methyl vinyl ether), polyvinyl alcohols), ethylene vinyl alcohol, Poly(ethylene glycol)-block-poly(propylene glycol)-blockpoly(ethylene glycol), Polyvinyl alcohol-co-ethylene), Poly(vinyl alcohol-co-vinyl acetate-co-itaconic acid), Polyvinyl chloride-co-vinyl acetate-co-vinyl alcohol), Polyvinyl butyral-co-vinyl alcohol-co-vinyl acetate), Poly(4-vinylphenol), poly(vinyl ketones), poly(vinyl nitriles), polyvinyl esters), poly(vinyl acetate), poly ethylene vinyl acetate, polyvinyl pyridines), poly(2-vinyl pyridine), poly(5-methyl-2-vinyl pyridine), Poly(4-vinylpyridine), Poly(4-vinylpyridine-co-styrene), Polyvinylpyrrolidone, Polyvinylchlorides, polyvinylchloride, Polyvinylidene chloride, Poly(vinylbenzyl chloride), Poly(vinylidene fluoride), ethylenevinyl co-polymers; Polystyrenes, Polystyrene (PS), Acrylonitrile butadiene styrene (ABS), High impact polystyrene (HIPS), Extruded polystyrene (XPS), Expandable Polystyrene Bead, poly(sodium styrene sulfonate), any other polystyrene; polydienes, polybutadiene; Polyamides, Polyamide (PA), poly(polyphthalamide) (PPA), Polyphthalamide, poly(bismaleimide) (BMI), poly (urea formaldehyde) (UF), polyurea, nylons, amorphous nylon, nylon Type 11, nylon Type 12, nylon Type 46, nylon Type 6, nylon Type 6/66 Copolymer, nylon Type 610, nylon Type 66, nylon Type 69, Nylon/Polypropylene Alloy, Poly glutamic acid, Aramids, meta aramids, para-aramids, kevlar, poly-metaphenylene isophtalamides, poly p-phenylene terephtalamides, Technora, Sulfron 3000, Cyamelide, Sodium poly(aspartate), any other polyamide; Polyamide-Imides; Polyester-imides; Polyarylethers; Polyaryletherketone; Polysulfones, Polysulfone (PSU), Polyarylsulfone (PAS), Polyethersulfone (PES), Polyphenylsulfone (PPS), Poly(i-decene-sulfone), Poly(i-dodecene-sulfone), Poly(I-hexadecene-sulfone), Poly(I-hexene-sulfone), Poly(I-octene-sulfone), Poly(I-tetradecene-sulfone), any other polysulfone; Polyesters, Polyethylene terephthalate (PET), polybutyrate, alkyds, Capilene, Glycerine phthalate, Polybutylene terephthalate, Polycaprolactone, Polydioxanone, Polyethylene naphthalate, Polyglycolide, Polyhydroxyalkanoates, poly-beta-hydroxybutyrate, polyhydroxybutyrate-valerate, Polyhydroxybutyrate, polyhydroxyvalerate, polyhydroxyhexanoate, polyhydroxyoctanoate, polylactic acid, Polytrimethylene terephthalate, poly diallyl isophthalate, poly diallyl phthalate; Polyacrylamides; Polyketones, Polyetheretherketone (PEEK), Polyetherketone (PEK), any other polyketone; Polyetherimides; Polyalkenes; Polyimides; Fluoropolymers, polytetrafluoroethylene (PTFE, Teflon), poly perfluoroalkoxy polymer resin (PFA), poly fluorinated ethylene-propylene (FEP), Poly Ethylene TetrafluoroEthylene (ETFE, Tefzel, Fluon), Polychlorotrifluoroethylene, (ECTFE, Turcite, Halar), PolyVinylidine DiFluoride (PVDF, Kynar), FFKM (Kalrez, Tecnoflon FFKM), FKM (Viton, Tecnoflon), Poly(hexafluoropropylene oxide), Poly(perfluoropropylene-oxide-co-perfluoroformaldehyde), Polychlorotrifluoroethylene, any other fluorinated polymer; polyurethanes, Polyurethane (PU), Polyisocyanurate (PIR), any other polyurethane; polyolefins, Polyethylene (PE), Low density polyethylene (LDPE), High density polyethylene (HDPE), Crosslinked polyethylene (XLPE), Polypropylene (PP), Polybutylene (PB), Polymethylpentene, Polyisobutene, (PIB) Biaxially-oriented polypropylene, Expandable Polyolefin Bead, tyvek, poly-(ethylene oxamide-N,N'-diacetate), complexes of poly-(ethylene oxamide-N,N'-diacetate) with metal ions, any other polyolefin; Polyepoxides; polyethers, poly ether ether ketone, polydioxanone, polyethylene glycol, Poly(hexafluoropropylene oxide), polyoxymethylene, polyethylene glycol, techron, Phenylene Ether/Oxide (PPO/PPE) Based Resins; Poly(allylamine); Polyphenylene Sulfide (PPS); Polycondensates having nitrogen-containing heterocyclic rings in the main chain; Polyhydrazides; Polytriazoles; Polyamino-triazoles; Polyoxadiazoles; Polythiophenes; polyaniline; polyphenols; Poly(tetrahydrofuran); Ionomers; Spectralon thermoplastic resin; Liquid Crystal Polymers; Plasticisols; Organosols; DCPD Resin; Furan; Melamine; Silicones; cationic polymers, poly(4-hydroxy-L-proline ester), Poly(γ-(4-aminobutyl)-L-glycolic acid), poly(amino esters), cystamine bisacrylamides, poly(amido amine)s, polyurethanes containing poly(ethylene glycol) in the backbone, poly(L-lysine)s, poly(L-lysine)-poly(ethylene glycol)-poly(lactic-co-glycolic acid) hybrid polymers, poly(L-lysine)-poly(ethylene glycol) block co-polymers, poly (ethylene imine), poly(phosphazenes), poly(phosphoesters), poly(phosphoramidates), phosphorylcholine, poly(glycolode), poly(glycolide), poly(lactic acid), poly(L-lactide), poly(D,L-lactide), poly(caprolactone), poly(anhydride), poly (alkylcyanoacrylate), poly(ethyl-2-cyanoacrylate), poly(butylcyanoacrylate), poly(hexylcyanoacrylate), poly(octylcyanoacrylate), Polycaprolactone diol, poly(lactide-co-glycolide), poly(D,L-lactide-co-glycolide), poly(lactide-co-caprolactone), poly(2-ethyl-2-oxazoline)-block-poly (caprolactone), poly(ethylene oxide)-poly(DL-lactic-co-glycolic acid) co-polymer, Poly(L-lactide-co-caprolactone-co-glycolide), Poly(DL-lactide-co-glycolide), Poly[(R)-3-hydroxybutyric acid], Poly(1,4-butylene adipate-co-polycaprolactam), Poly(DL-lactide-co-caprolactone), Poly (3-hydroxybutyric acid-co-3-hydroxyvaleric acid), Poly(1,4-butylene adipate-co-1,4-butylene succinate), extended with 1,6-diisocyanatohexane, Poly(1,4-butylene succinate), extended with 1,6-diisocyanatohexane, Nylon 6, poly(ethylene glycol), poly(propylene glycol), poly(ethylene glycol) based polymers, Di[poly(ethylene glycol)]adipate, Poly(propylene glycol)bis(2-aminopropyl ether), Poly(propylene glycol), tolylene 2,4-diisocyanate terminated, Poly(propylene glycol)diglycidyl ether, Poly(propylene glycol)monobutyl ether, Hexaethylene glycol, Pentaethylene glycol, Polyethylene-block-poly(ethylene glycol), Poly(ethylene glycol) acrylate, Poly(ethylene glycol)bis(3-aminopropyl) terminated, Poly(ethylene glycol)bis(carboxymethyl) ether, Poly(ethylene glycol) butyl ether, Poly(ethylene glycol)diacrylate, Poly (ethylene glycol)dimethacrylate, Polyethylene glycol dimethyl ether, Polyethylene glycol distearate, Poly(ethylene glycol)divinyl ether, Poly(ethylene glycol) ethyl ether methacrylate, Poly(ethylene glycol) 2-[ethyl[(heptadecafluorooctyl)sulfonyl]amino]ethyl ether, Poly(ethylene glycol) 2-ethyl [(heptadecafluorooctyl)sulfonyl]amino]ethyl methyl ether, Poly(ethylene glycol), a-maleimidopropionamide-formyl Terminated, Poly(ethylene glycol) methacrylate, Poly(ethylene glycol) methyl ether, Poly(ethylene glycol) methyl ether-block-poly(e-caprolactone), Poly(ethylene glycol) methyl ether-block-polylactide, Poly(ethylene glycol) methyl ether methacrylate, Poly(ethylene glycol) myristyl tallow ether, Poly(ethylene glycol) 4-nonylphenyl ether acrylate, Poly (ethylene glycol) phenyl ether acrylate, Poly(ethylene glycol) reacted with Bisphenol A diglycidyl Ether, Poly(ethylene glycol)tetrahydrofurfuryl ether, Poly(ethylene oxide), Poly (ethylene oxide)-block-polycaprolactone, four-arm, Poly (ethylene oxide)-block-polylactide, four-arm, Poly(ethylene oxide) four-arm amine terminated, carboxylic acid terminated, hydroxyl terminated, succinimidyl glutarate terminated, succinimidyl succinate terminated, thiol terminated, Poly(ethylene oxide) six arm hydroxyl terminated, Tetraethylene glycol dimethyl ether, Poly(ethylene glycol)-poly(propylene glycol) co-polymers, Poly(ethylene glycol)-block-poly(propylene glycol)-blockpoly(ethylene glycol), Poly (ethylene glycol-ran-propylene glycol), Poly(ethylene glycol-ran-propylene glycol)monobutyl ether, Poly(propylene glycol)-block-poly(ethylene glycol)-blockpoly(propylene glycol), Poly(propylene glycol)-block-poly(ethylene glycol)-blockpoly(propylene glycol)bis(2-aminopropyl ether), Poly(isobutylene-co-maleic acid), Lignosulfonic acid sodium salt, Poly[(isobutylene-alt-maleic acid), ammonium salt)-co-(isobutylene-alt-maleic anhydride)], Poly(isobutylene-alt-maleic anhydride), Poly[(isobutylene-alt-maleinnide)-co-(isobutylene-altmaleic anhydride)], Poly(methyl vinyl ether-alt-maleic anhydride), The method of claim 91 wherein the biopolymers are of, but not limited to: polysaccharides, starch, Algal starch, glycogen, cellulose based biopolymers, cellulose acetates, cellulose ethers, cellulose acetate, cellulose acetate butyrate, cellulose acetate propionate, ethyl cellulose, cellulose propionate, cellulose acetate phthalate, methyl cellulose, hydroxy ethyl cellulose, hydroxypropyl methyl cellulose, carboxymethylcellulose, (Acrylamidomethyl)cellulose acetate butyrate, (Acrylamidomethyl) cellulose acetate propionate, Cellulose acetate trimellitate, Cellulose, cyanoethylated, Cellulose nitrate, Cellulose powder, Cellulose triacetate, Hydroxyethylcellulose ethoxylate quaternized, 2-Hydroxyethyl cellulose hydrophobically modified, 2-Hydroxyethyl starch, Hydroxypropyl cellulose, (Hydroxypropyl)methyl cellulose, Hydroxypropyl methyl cellulose phthalate, Methyl 2-hydroxyethyl cellulose, Sodium carboxymethyl cellulose, chitin, chitosan, chitosan oligosaccharide lactate, pectin, acidic polysaccharides, xanthan gum, dextran, gellan gum, pullulan, carrageenan, chondrotin, Dextrin palmitate, Maltodextrin, agar, Alginic acid sodium salt; gelatine; collagen; alginate; hyaluronic acid; alginic acid; resins; polyenes; gums; proteins; polypeptides; nucleic acids; poly-3-hydroxybutyrate; Cutin or combinations and copolymers of the above.

Similarly exemplary antecedent ceramic, metal and glass materials include particulate, solutions, suspensions, gels, sols and colloids of oxides, nitrides, nitrates, carbides, carbonates, sulfates, halides and phosphates. Such antecedent compositions may also comprise organo-metallics including the carboxylates, alkoxides and esters of metals particularly those of calcium, phosphorous, titanium, silicon, aluminum, sulfur, nickel, vanadium, zirconium, yittrium, precious metals and the lanthanides.

A suitable application of the process of the present application is directed toward adhering active coatings to implantable medical devices. In such applications the coating is comprised of a biocompatible carrier matrix and an active agent. Active agents that may be included in the antecedent composition and ultimately the coating, include: antibiotics, antirestentosis agents, immunosupressants, anti-inflammatory agents, hypolipidemic agents, anti-thrombosis agents, proteins, oligopeptides and the like.

Active agents that may be incorporated are by way of example Aminoglycosides, Amikacin, Gentamicin, Kanamycin, Neomycin, Netilmicin, Streptomycin, Tobramycin, Paromomycin, Ansamycins, Geldanamycin, Herbimycin, Carbacephem, Loracarbef, Carbapenems, Ertapenem, Doripenem, Imipenem/Cilastatin, Meropenem, Cephalosporins, first generation cephalosporins, Cefadroxil, Cefazolin, Cefalotin, Cefalexin, second generation cephalosporins, Cefaclor, Cefamandole, Cefoxitin, Cefprozil, Cefuroxime, third generation cephalosporins, Cefixime, Cefdinir, Cefditoren, Cefoperazone, Cefotaxime, Cefpodoxime, Ceftazidime, Ceftibuten, Ceftizoxime, Ceftriaxone, Cefdinir, fourth generation cephalosporins, Cefepime, Glycopeptides, Teicoplanin, Vancomycin, Dalbavancin, Telavancin, Macrolides, Azithromycin, Clarithromycin, Dirithromycin, Erythromycin, Roxithromycin, Troleandomycin, Telithromycin, Spectinomycin, Monobactams, Aztreonam, Penicillins, Amoxicillin, Ampicillin, Azlocillin, Carbenicillin, Cloxacillin, Dicloxacillin, Flucloxacillin, Mezlocillin, Meticillin, Nafcillin, Oxacillin, Penicillin, Piperacillin, Ticarcillin, Polypeptides, Bacitracin, Colistin, Polymyxin B, Quinolones, Ciprofloxacin, Enoxacin, Gatifloxacin, Levofloxacin, Lomefloxacin, Moxifloxacin, Norfloxacin, Ofloxacin, Trovafloxacin, Sulfonamides, Prontosil, Sulfacetamide, Sulfamethizole, Sulfan mide, Sulfasalazine, Sulfisoxazole, Trimethoprim, Trimethoprim-Sulfamethoxazole (Co-trimoxazole) (TMP-SMX), Tetracyclines, Doxycycline, Vibramycin, Minocycline, Minocin, Oxytetracycline, Terracin, Tetracycline, arylmorpholinoacids (AMPAs), S-arylmorpholinoacids, N-methyl AMPA, N,N-dimethyl AMPA, Arsphenamine, Chloramphenicol, Clindamycin, Lincomycin, Ethambutol, Fosfomycin, steroid antibiotics, Fusidic acid, Furazolidone, Isoniazid, Linezolid, imidazole derivatives, Metronidazole, Tinidazole, ornidazole, nitrofuran derivatives, nitrofurantoin, nifurtoinol, Mupirocin, Nitrofurantoin, Platensimycin, Pyrazinamide, Quinupristin/Dalfopristin, Rifampicin, Polymyxins, colistin, polymyxin B, xibornol, clofoctol, methenamine, mandelic acid, Nitroxoline, daptomycin, Hitachimycin; antivirals, Interferons, Entry inhibitors, Maraviroc, Enfuvirtide, Epigallocatechin gallate, Griffithsin, Integrase inhibitors, Protease inhibitors, Saquinavir, Ritonavir, Indinavir, Nelfinavir, Amprenavir, Lopinavir, Atazanavir, Fosamprenavir, Tipranavir, Darunavir, Nucleoside analogues, deoxyadenosine analogues, Didanosine, Vidarabine, deoxycytidine analogues, Cytarabine, Emtricitabine, Lamivudine, Zalcitabine, deoxyguanosine analogues, Abacavir, (deoxy-) thymidine analogues, Stavudine, Zidovudine, deoxyuridine analogues, Idoxuridine, Trifluridine, Reverse transcriptase inhibitors, Nucleoside analog reverse transcriptase inhibitors, Zidovudine, Didanosine, Zalcitabine, Stavudine, Lamivudine, Abacavir, Emtricitabine, Nucleotide analog reverse transcriptase inhibitors, Tenofovir, Adefovir, Non-nucleoside reverse transcriptase inhibitors, Efavirenz, Nevirapine, Delavirdine, Etravirine, portmanteau inhibitors, Aciclovir, Acyclovir, Amantadine, Arbidol, Atripla, Brivudine, Cidofovir, Combivir, Docosanol, Edoxudine, Enfuvirtide, Enfuvirtide, Famciclovir, Fomivirsen, Foscarnet, Fosfonet, Ganciclovir, Gardasil, Ibacitabine, Imunovir, Imiquimod, Inosine, Loviride, MK-0518, Maraviroc, Moroxydine, Nexavir, Oseltamivir, Penciclovir, Peramivir, Pleconaril, Podophyllotoxin, Ribavirin, Rimantadine, Tenofovir disoproxil, Trizivir, Tromantadine, Truvada, Valaciclovir, Valganciclovir, Vicriviroc, Viramidine, Zanamivir; synergistic enhancers of antiretrovirals, Chloroquine/quinoline antimalarials, Hydroxyurea, Leflunomide, Mycophenolic acid, Resveratrol, Ritonavir; antifungals, Polyene antifungals, Natamycin, Rimocidin, Filipin, Nystatin, Amphotericin B, Imidazole and triazole antifungals, Miconazole, Ketoconazole, Clotrimazole, Econazole, Bifonazole, Butoconazole, Fenticonazole, Isoconazole, Oxiconazole, Sertaconazole, Sulconazole, Tioconazole, Fluconazole, Itraconazole, Isavuconazole, Ravuconazole, Posaconazole, Voriconazole, Terconazole, Allylamines, Terbinafine, Amorolfine, Naftifine, Butenafine, Echinocandins, Anidulafungin, Caspofungin, Micafungin, Benzoic Acid combined with a keratolytic agent, Ciclopirox, Flucytosine, Griseofulvin, Gentian Violet, Haloprogin, Tolnaftate, Undecylenic acid, Tea tree oil, Citronella oil, lemon grass, orange oil, palmarosa oil, patchouli, lemon myrtle, Neem seed oil, coconut oil; antiparasitics, Antinematodes, Mebendazole, Pyrantel pamoate, Thiabendazole, Diethycarbazine, Anticestodes, Niclosamide, Praziquantel, Antitrennatodes, Praziquantel, Antiamoebics, Rifampin, Amphotericin B, Antiprotozoal, Melarsoprols, mono and di alkylating agents, nitrogen mustards, chlorambucil, chlormethine, cyclophosphamide, ifosfamide, melphalan, uramustine, mechlorethamine, nitrosoureas compounds, carmustine, fotemustine, lomustine, streptozocin, platinum compounds, carboplatin, cisplatin, oxaliplatin, BBR3464, satraplatin, busulfan, dacarbazine, procarbazine, temozolomide, thioTEPA, treosulfan, hexamethylmelamine; antimetabolites, folic acid analogues, aminopterin, methotrexate, pemetrexed, raltitrexed, trimethoprim, pyrimethamine, purine analogues, cladribine, clofarabine, fludarabine, fludarabine phosphate, mercaptopurine, pentostatin, thioguanine, azathioprine, pyrimidine analogues, capecitabine, cytarabine, fluorouracil, 5-fluorocil, floxuridine, gemcitabine, daunorubicin, doxorubicin, epirubicin; plant alkaloids, vinca alkaloids, vinblastine, vinblastine sulphate, vincristine, vincristine sulphate, vindesine, vinorelbine, podophyllotoxin, taxanes, docetaxel, paclitaxel, Abraxane, 7-deoxytaxol, 10-deacetoxytaxol, paclitaxel analogs with ortho and meta-substituted aroyl substituents and all other paclitaxel derivatives; terpenoids; topoisomerase inhibitors, inhibitors of the topoisomerase I and topoisomerase II enzymes, irinotecan, topotecan, camptothecin and lamellarin D, amsacrine, etoposide, etoposide phosphate, teniposide and doxorubicin, fluoroquinolones; cytoxic/antitumour antibiotics, idarubicin, mitoxantrone, pixantrone, valrubicin, actinomycin, bleomycin, mitomycin, mitomycin-C, plicamycin, hydroxyurea, dactinomycin; monoclonal antibodies, cetuxinnab, panitumumab, trastuzumab, rituximab, tositumomab, alemtuzumab, bevacizumab, gemtuzumab; tyrosine kinase inhibitors, cediranib, dasatinib, erlotinib, gefitinib, imatinib, lapatinib, nilotinib, sorafenib, sunitinib, vandetanib; photosensitizers, aminolevulinic acid, methyl aminolevulinate, porfimer sodium, verteporfin; retinoids, alitretinoin, tretinoin; other anti-tumour agents, altretamine, amsacrine, anagrelide, arsenic trioxide, asparaginase (pegaspargase), bexarotene, bortezomib, denileukin diftitox, estramustine, ixabepilone, masoprocol, mitotane, testolactone, helenalin; glucocorticoids, cortisone, Cortisol, alclometasone, amcinonide, beclometasone, betamethasone, budesonide, ciclesonide, clobetasol, clobetasone, clocortolone, cloprednol, cortivazol, deflazacort, deoxycorticosterone, desonide, desoximetasone, dexamethasone, diflorasone, diflucortolone, difluprednate, fluclorolone, fludrocortisone, fludroxycortide, flumetasone, flunisolide, fluocinolone acetonide, fluocinonide, fluocortin, fluocortolone, fluorometholone, fluperolone, fluprednidene, fluticasone, formocortal, halcinonide, halometasone, hydrocortisone aceponate, hydrocortisone buteprate, hydrocortisone butyrate, loteprednol, medrysone, meprednisone, methylprednisolone, methylprednisolone aceponate, mometasone furoate, paramethasone, prednicarbate, prednisone, prednisolone, prednylidene, rimexolone, tixocortol, triamcinolone, ulobetasol and all derivatives of said glucocorticoids; antibodies, polyclonal antibodies, monoclonal antibodies, T-cell receptor directed monoclonal antibodies, IL-2 receptor monoclonal antibodies, infliximab, basiliximab, abciximab, daclizumab, palivizumab, etanercept, cetuximab, panitumumab, trastuzumab, rituximab, tositumomab, alemtuzumab, bevacizumab, gemtuzumab, TNF inhibitors, adalimumab, certolizumab pegol, afelimomab, aselizumab, atlizumab, atorolimumab, belimumab, bertilimumab, cedelizumab, clenoliximab, dorlimomab aritox, dorlixizumab, eculizumab, efalizumab, elsilimomab, erlizumab, faralimomab, fontolizumab, galiximab, gantenerumab, gavilimomab, golimumab, gomiliximab, ibalizumab, inolimomab, ipilimumab, kelixiimab, lebrilizumab, lerdelimumab, lumiliximab, maslimomab, mepolizumab, metelimumab, morolimumab, muroimonab-CD3, natalizumab, nerelimomab, ocrelizumab, odulimomab, omalizumab, otelixizumab, pascolizumab, pexelizumab, reslizumab, rovelizumab, ruplizumab, siplizumab, talizumab, telimomab aritox, teneliximab, teplizumab, tocilizumab, toralizumab, vapaliximab, vepalimomab, visilizumab, zanolimumab, ziralimumab, zolimomab aritox, directed human antibodies, murine antibodies, humanised antibodies, chimeric antibodies; drugs acting on innmunophilins, cyclosporine, tacrolimus, sirolimus; interferons, IFN-β, IFN-γ; opioids, natural opioids, morphine, codeine, thebaine, papaverine, noscapine, oripavine, semi-synthetic opioids, hydromorphone, hydrocodone, oxycodone, dihydrocodeine, nicomorphine, oxymorphone, synthetic opioids, Anilidopiperidines, Fentanyl, Alfentanil, Sufentanil, Remifentanil, Carfentanyl, Ohmefentanyl, Phenylpiperidines, Pethidine, Ketobemidone, Allylprodine, prodine, Diphenylpropylamine derivatives, Propoxyphene, Dextropropoxyphene, Dextromoramide, Bezitrannide, Piritrannide, Methadone, Dipipanone, Levo-alphacetylmethadol, Loperamide, Diphenoxylate, Benzomorphan derivatives, Pentazocine, Phenazocine, Oripavine derivatives, Buprenorphine, Etorphine, Morphinan derivatives, butorphanol, nalbuphine, levorphanol, levomethorphan, Dezocine, Lefetamine, Meptazinol, Tilidine, Tramadol, Tapentadol, Nalmefene, Naloxone, Naltrexone, endogenous opioids; other immunosuppressant agents, beta-2'-deoxythioguanosine, bisantrene HCl, bleomycin sulfate, buthionine sulfoximine, BWA 773U82, BW 502U83.HCl, BW 7U85 mesylate, ceracemide, carbetimer, chloroquinoxaline-sulfonamide, chlorozotocin, chromomycin A3, corticosteroids, *Corynebacterium parvum*, CPT-11, crisnatol, cyclocytidine, cytembena, dabis maleate, deazauridine, dexrazoxane, dianhydrogalactitol, diaziquone, dibromodulcitol, didemnin B, diethyldithiocarbamate, diglycoaldehyde, dihydro-5-azacytidine, echinomycin, edatrexate, edelfosine, eflornithine, Elliott's solution, elsamitrucin, esorubicin, estramustine phosphate, estrogens, etanidazole, ethiofos, fadrazole, fazarabine, fenretinide, filgrastim, finasteride, flavone acetic acid, 5-fluorouracil, Fluosol®, flutamide, gallium nitrate, gemcitabine, goserelin acetate, hepsulfam, hexamethylene bisacetamide, homoharringtonine, hydrazine sulfate, 4-hydroxyandrostenedione, hydrozyurea, interferon alfa, interferon beta, interferon gamma, interleukin-1 alpha and beta, interleukin-3, interleukin-4, interleukin-6,4-ipomeanol, iproplatin, isotretinoin, leucovorin calcium, leuprolide acetate, levamisole, liposomal daunorubicin, liposome encapsulated doxorubicin, lonidamine, maytansine, menogaril, merbarone, mesna, methanol extraction residue of Bacillus calmette-guerin, N-methylformamide, mifepristone, mitoguazone, monocyte/macrophage colony-stimulating factor, nabilone, nafoxidine, neocarzinostatin, octreotide acetate, ormaplatin, oxaliplatin, paclitaxel, pala, piperazinedione, pipobroman, pirarubicin, piritrexim, piroxantrone hydrochloride, PIXY-321, porfimer sodium, prednimustine, procarbazine, progestins, pyrazofurin, razoxane, sargramostim, semustine, spirogermanium, spiromustine, streptonigrin, sulofenur, suramin sodium, tamoxifen, taxotere, tegafur, teniposide, terephthalamidine, teroxirone, thiotepa, thymidine injection, tiazofurin, toremifene, trifluoperazine hydrochloride, trifluridine, trimetrexate, tumor necrosis factor, uracil mustard, vinzolidine, Yoshi 864, zorubicin, TNF binding proteins, mycophenolate, fingolimod, myrocin, Everolimus, Gusperinnus, Pimecrolimus, Sirolimus, Zotarolimus, Tacrolimus, Temsirolimus, Abatacept, Alefacept, Belatacept, TNF inhibitor, Etanercept, Anakinra, Azathioprine, Ciclosporin, Leflunomide, Methotrexate, Mycophenolic acid, Thalidomide, acivicin, aclarubicin, acodazole, acronycine, adozelesin, alanosine, aldesleukin, allopurinol sodium, aminoglutethimide, amonafide, ampligen, androgens, anguidine, aphidicolin glycinate, asaley, 5-azacitidine, Bacillus calmette-guerin (BCG), Baker's Antifol (soluble), steroidal drugs, glucocorticoids, cortisone, Cortisol, alclometasone, amcinonide, beclometasone, betamethasone, budesonide, ciclesonide, clobetasol, clobetasone, clocortolone, cloprednol, cortivazol, deflazacort, deoxycorticosterone, desonide, desoximetasone, dexamethasone, diflorasone, diflucortolone, difluprednate, fluclorolone, fludrocortisone, fludroxycortide, flumetasone, flunisolide, fluocinolone acetonide, fluocinonide, fluocortin, fluocortolone, fluorometholone, fluperolone, fluprednidene, fluticasone, formocortal, halcinonide, halometasone, hydrocortisone aceponate, hydrocortisone buteprate, hydrocortisone butyrate, loteprednol, medrysone, meprednisone, methylprednisolone, methylprednisolone aceponate, mometasone furoate, paramethasone, prednicarbate, prednisone, prednisolone, prednylidene, rimexolone, tixocortol, triamcinolone, ulobetasol and all derivatives of said glucocorticoids; Non-steroidal anti-inflammatory drugs, cyclooxygenase inhibitors, Salicylates, Acetylsalicylic acid, Amoxiprin, Benorilate, Choline magnesium salicylate, Diflunisal, Faislamine, Methyl salicylate, magnesium salicylate, salicyl salicylate, Arylalkanoic acids, Diclofenac, Aceclofenac, Acemetacin, Bromfenac, Etodolac, Indometacin, nabumetone, sulindac, tolmetin, Arylpropionic acids, Fenbufen, Fenoprofen, Flurbiprofen, Ketoprofen, Ketorolac, Loxoprofen, ibuprofen, carprofen, naproxen, oxaprozin, tiaprofenic acid, suprofen, N-Arylanthranilic acids, Mefenamic acid, Meclofenamic acid, Pyrazolidine derivatives, Phenylbutazone, Azapropazone, Metamizole, Oxyphenbutazone, Sulfinpyrazone, Oxicams, Piroxicam, Lornoxicam, Meloxicam, Tenoxicam, COX-2 Inhibitors, Celecoxib, NS-398, RS-57067, Etoricoxib, flosulid, APHS, Lumiracoxib, meloxicam, SC-57666, Parecoxib, S-2474, Rofecoxib, etodolac, JTE-522, DuP-697, Valdecoxib, celecoxib, SC-58125, Sulphonanilides, L-745337, L-748780, L-761066, Nimesulide, valdecoxib, COX-inhibiting nitric oxide donators, Fluproquazone, Licofelone, Omega-3 fatty acids, herb extracts, extracts of hyssop, ginger, Turmeric, *Arnica montana*, sesquiterpene lactone and willow bark, Helenalin, capsaicin, thrombolytics, anticoagulants, antiplatelet drugs, Vitamin K antagonists, Acenocoumarol, Clorindione, Coumatetralyl, Dicumarol, Diphenadione, Ethyl biscoumacetate, Phenprocoumon, Phenindione, Tioclomarol, Warfarin, heparins, Antithrombin III, Danaparoid, Heparin, Sulodexide, low molecular weight heparins, Bemiparin, Dalteparin, Enoxaparin, Nadroparin, Parnaparin, Reviparin, Tinzaparin, glycoprotein IIb/IIIa inhibitors, Abciximab, Eptifibatide, Tirofiban, ADP receptor inhibitors, Clopidogrel, Ticlopidine, Prasugrel, prostaglandin analogues, Beraprost, Prostacyclin, Iloprost, Treprostinil, Enzymes, plasminogen activators, Alteplase/Reteplase/Tenecteplase, Streptokinase, Urokinase/Saruplase, Anistreplase, serine endopeptidases, Ancrod, Drotrecogin alfa/Protein C, Fibrinolysin, Brinase, Direct thrombin inhibitors, Argatroban, bivalirudin, Dabigatran, Desirudin, Hirudin, Lepirudin, Melagatran, Ximelagatran, Acetylsalicylic acid, Aloxiprin, Ditazole, Carbasalate calcium, Cloricromen, Dipyridamole, Indobufen, Picotamide, Triflusal, Apixaban, Defibrotide, Dermatan sulfate, Fondaparinux, Rivaroxaban, Tissue plasminogen activator, statins, Atorvastatin, Cerivastatin, Fluvastatin, Lovastatin, Mevastatin, Pravastatin, Pravastatin, Rosuvastatin, Simvastatin, fibrates, Clofibrate, Bezafibrate, Aluminium clofibrate, Gemfibrozil, Fenofibrate, Simfibrate, Ronifibrate, Ciprofibrate, Etofibrate, Clofibride, niacin, niacin derivatives, Niceritrol, Nicofuranose, Aluminium nicotinate, Nicotinyl alcohol, Acipimox, bile acid sequesterants, Colestyramine, Colestipol, Colextran, Colesevelam, ezetinnibe, phytosterols, cholestatin, campesterol, stigmasterol, brassicasterol, β-sitosterol, ergosterol, CETP Inhibitors, squalene synthase inhibitor, ApoA-1 Milano, AGI-1067, Dextrothyroxine, Probucol, Tiadenol, Benfluorex, Meglutol, Omega-3-triglycerides, Magnesium pyridoxal 5-phosphate glutamate, Policosanol, Ezetimibe, agents which engineer the Antisense knockdown of the protooncogene c-myc, Morpholino oligonucleotides, immunosuppressant and anticancer drugs: sirolimus/rapamycin, tacrolinnus, everolimus, zotarolimus, paclitaxel, docetaxel, paclitaxel derivatives, tranilast and the like, enzymes, enzymes involved in metabolism, catabolism, DNA replication, DNA repair, RNA synthesis, post-translational modification of other proteins; structural proteins, F-actin, α-tubulin and β-tubulin, Class III β-tubulin, γ-tubulin, δ and ϵ tubulin, microtubules of tubulin, collagen, elastin, cartilage, keratin, motor proteins, bone morphogenic protein, proteins involved in osteogenesis, heparin, myosin, kinesin, dynein; proteins involved in cell signalling and signal transduction; proteins involved in ligand transportation, membrane proteins; transmembrane proteins; ion channel proteins; antibodies; human Ribo Nucleic Acids; and human Deoxyribo Nucleic Acids among others.

In a further application, the current coating method may be used to adhere a biocidal or bacteriostatic coating to surfaces generally at risk of being colonized by bacteria. In particular the surfaces of medical equipment, surgical instruments and surfaces generally exposed in the health care environment may be rendered biocidal. Suitable active agents that may be used in conjunction with carrier matrices for such applications include antimicrobial polymers, N-halamines, nitrogen containing polymers, quaternary ions and colloidal metals. Examples include: poly(4-acrylamido-Λ/-(5-methyl-3-isoxazolyl)benzenesulfonamide), poly/4-methacrylamido-Λ/-(5-methyl-3-isoxazolyl)-benzenesulfonamide), poly(Λ/-[4-sulfamido-Λ/-(5-methyl-3-isoxazolyl)phenyl]-maleimide, poly(Λ/-tri-n-butyltin maleimide-co-styrene-co-m-acryloylamino-(tri-n-butyltinbenzoate), poly(2-hydroxy-3-

(5-methyl-1,3,4-thiadiazol-2-yl)thiopropyl methacrylate), poly(l-ethyl-6-fluoro-7-{4-[2-hydroxy-3-)2-methylacryloyloxy)propyl]piperazin-1-yl}-4-oxo-1,4-dihydroquinolin-3-carboxylic acid), poly(2,4,4'-trichloro-2'-acryloyloxydiphenyl ether), poly(2,4,4'-trichloro-2'-acryloyloxydiphenyl ether-co-mehtylmethacrylate), poly(2,4,4'-trichloro-2'-acryloyloxydiphenyl ether-co-styrene), poly(2,4,4'-trichloro-2'-acryloyloxydiphenyl ether-co-acrylic acid), poly(allyl p-hydroxyphenyl acetate), poly(p-hydroxyphenyl acetate), poly (p-2-propenoxyphenol), poly(p-phenylcarboxy acetate), poly(3-acryloxypropyl o-carboxybenzoate), poly(3-methacryloxy p-hydroxyphenyl acetate), N-cyclic halamines, chlorine bleached polymers, chlorine bleached poly(1-acryloyl-2,2,5,5-tetramethylimidazolidin^-one-co-acrylonitrile), chlorine bleached poly(1-acryloyl-2,2,5,5-tetramethylimidazolidin-4-one-co-methylmethacrylate), chlorine bleached poly(1-acryloyl-2,2,5,5-tetramethylimidazolidin-4-one-co-vinyl alcohol), poly(5-chloro-8-quinolinyl acrylate), poly(acylic acid-co-5-chloro-8-quinolinyl acrylate), poly(acrylamide-co-5-chloro-8-quinolinyl acrylate), poly(Λ/-vinyl-2-pyrrolidone-co-5-chloro-8-quinolinyl acrylate), poly(p-vinylbenzyltetramethylenesulfonium tetrafluoroborate), poly(p-ethylbenzyl tetramethylenesulfonium tetrafluoroborate), poly(methacryloyloxydodecyl pyrimidinium bromide), poly(methacryloyloxydodecyl pyrimidinium bromide-co-acrylic acid), poly(quaternary amine methacrylate-co-2-hydroxyethyl methacrylate), poly(trialkyl-3-vinylbenzyl]phosphonium chloride), poly(trialkyl-4-vinylbenzyl] phosphonium chloride), poly(2,4-dichlorophenyl acrylate), poly(2,4-dichlorophenyl acrylate-co-vinyl acetate), poly(3-triethoxysilylpropyl-5,5-dimethylhydantoin), poly(vinylbenzyl chloride-co-2-chloroethyl vinyl ether), poly(vinylbenzyl chloride-co-methylmethacrylate) quaternized with triphenylphosphine and triethylamine; RAAS-4G treated with p-hydroxybenzoic acid, 2,4-dihydroxybenzoic acid, and 3,4,5-trihydroxybenzoic acid; 2-benzimidazolecarbamoyl moiety coupled to poly(ethylene-co-vinyl alcohol); poly(styrene-co-maleic anhydride) coupled to ampicillin; poly(styrene-co-maleic anhydride) coupled to 4-aminophenol; poly (methacryloyloxyethyl trioctyl phosphonium chloride-co-Λ/-isopropylacrylamide); sulfopropylbetaine copolymers; poly[4-(2-tributylphosphonioethyl) styrene chloride-co-4-(2-chloroethyl)-styrene]; poly[4-(3-tributylphosphoniopropyl)-styrene chloride-co-4-(3-chloropropyl)styrene]; glycidyl methacrylate-1,4-divinylbenzene copolymer treated with hydrogen chloride and then triethylamine or Λ/,Λ/-dimethyloctylamine or Λ/,Λ/-dimethyldodecylamine or N,N-dimethylhexadecylamine; glycidyl methacrylate-1,4-divinylbenzene copolymer treated with hydrogen chloride and then triethylphosphine or tributylphosphine or trioctylphosphine; phosphonium salts of styrene-7% divinylbenzene copolymer; the phosphonium and ammonium salts of glycidyl methacrylate polymers; poly(glycidyl methacrylate-co-2-hydroxyethyl methacrylate) quaternized with triethylamine, triphenylphosphine, and tributylphosphine; quaternary ammonium-functionalized poly(propylene imine); quaternary phosphonium-functionalized poly(propylene imine); poly(ethylene glycol-N-hydantoin); poly(ethylene glycol-N-imidazolidin-4-one); polystyrene hydantoins; polystyrene triazinedione; poly[1,3,5-trichloro-6-methyl-6-(4'vinylphenyl)-1,3,5-triazine-2,4-dione]; chloromethylated polystyrene beads coupled with the potassium salt of 5,5-dimethylhydantoin; chloromethylated polystyrene beads coupled with dimethyldodecylamine; chloromethylated polystyrene beads coupled with Λ/,Λ/,Λ/',Λ/'-tetramethylethylenediamine; N-halogenated poly(styrenehydantoins); poly [3-(5,5-dimethylhydantoinylpropyl) siloxane-co-3-dimethyldodecylammoniumpropylsiloxane chloride]; poly[3-(5,5-dimethylhydantoinylpropyl) hydroxysiloxane]; chitosan-alginate hydrogels; poly(2-chloroethylvinyl ether-co-vinylbenzyl chloride) quaternized with triethylamine or triphenylphosphine or tributylphosphine; Quaternized poly (vinylpyridine), co-polymers of Polyethyleneglycol methyl ether methacrylate (PEGMA) and hydroxyethyl methacrylate (HEMA) and Quaternized poly(vinylpyridine), quaternized N-alkyl chitosan; N-alkyl chitosan quaternized with methyl iodide; chitosan-grafted poly(ethylene terephthalate); quaternized chitosan-grafted poly(ethylene terephthalate); chitosan-g-mono(2-methacryloyloxyethyl) acid phosphate; chitosan-g-vinylsulfonic acid sodium salt; Λ/-(2-Hydroxy) propyl-3-trimethylammonium chitosan chloride; dipyridyl dextran conjugates; N-benzyldipyridyl dextran conjugates; N-n-octyldipyridyl dextran conjugates; Loofah fibre grafted Methacryloyloxyethyl trimethyl ammonium chloride, Loofah fibre grafted tributyl-4-vinylbenzyl phosphonium chloride; Loofah fibre grafted 2,3-epithiopropyl methacrylate; Loofah fibre grafted 2,3-epithiopropyl methacrylate quaternized with triethylenetetramine; Loofah fibre grafted 2,3-epithiopropyl methacrylate quaternized with triethylenetetramine complexed with silver ions, N-methyl arylmorpholinoacid (AMPA), N,N-dimethyl AMPA, poly-(ethylene oxamide-N,N'-diacetate), complexes of poly-(ethylene oxamide-N,N'-diacetate) with metal ions, poly(4-[(4-hydroxybenzylidene)amino]phenol), polymers and co-polymers synthesized from the monomers 2,4-dichloro phenyl acrylate and 8-quinolinyl methacrylate, Copolymers of 2-acrylamido-2-methyl-1-propanesulfonic acid/maleic acid, Quaternary ammonium salts (QAS) modified polysiloxane, Poly(crotonic acid-co-2-acrylamido-2-methyl-1-propanesulfonic acid)-metal complexes with copper(II), cobalt (II), and nickel(11), mandelic acid condensation polymers, SAMMA, N-((4-amino sulfonyl)phenyl)acrylamide (APA), co-polymers of N-((4-amino sulfonyl)phenyl)acrylamide (APA) and 2-hydroxyethyl acrylate (HEA) and acrylic acid (AA), poly(2-(dimethylamino)ethyl methacrylate) with alkyl bromide modified tertiary amine groups, Poly[(mu(3)-N-acetyl-L-histidinato-kappa N-4,0:O:O')silver(I)], polyphenols, poly[(2-hydroxy-4-methoxybenzophenone)propylene] resin, N-quaternized chitosan and chitooligomer, acyated chitosans, silver(I) sulfanylcarboxylates and Quaternized polyethyleneimine, colloidal tin, nickel or silver among others.

Where the antimicrobial activity of the coating arises from polymers having n-halamine or their hydrogenated precursors attached thereto the liquid phase may additionally be augmented with halogen compounds such as for example methylenechloride, hypochlorite bleach and other such sources of halogen.

One may appreciate the advantage of acquiring commonly available plastics in powder form and being able to utilise these as is to form coatings by the processes of the present application. One may also appreciate the advantage of being able to augment polymers commonly available in powder form with biocidal functional group using the known complex and hazardous synthesis routes disclosed in the prior art in a controlled or closed environment and subsequently being able to form the so derivatised particles into a coating by the present invention in environments that are not conducive to the use of hazardous chemical processes such as surfaces in hospitals, industrial, domestic and food processing environments.

In one application the surface of interest may be of a building material such as for example the plaster, grout or concrete on walls and the machinery used to apply the process is mobile such as suitably modified mobile ultrasonic shot peeners and the like and the process may be applied to existing surfaces in constructed buildings.

In other biocidal coating applications the surface is of metal such as a surgical instrument the panels, handles, and other regularly contacted surfaces at or on doors, access and egress points, sinks, wash basins, dryers, work stations and the like.

Attractive features of the present process for modifying surfaces with active agents and coatings:

1. Although heat is generated at the surface this heat is highly localized and dissipates rapidly allowing active agents incorporated to survive the process intact. This is particularly true for aerosols generated from a liquid precursor as the liquid component serves to temper the heat generated.

2. Active agents are dispersed evenly within the coating incorporated in conjunction with the carrier matrix in a single step process in a controlled and tailored manner.

3. The process allows a sufficient density of antecedent material at the surface to form a continuous coating of greater than nanometer dimension.

4. The process circumvents the use of complex chemical additives such as cross-linking agents, stabilizers, initiators, silane or epoxy coupling agents and the curing treatments associated with other coating processes that facilitate the reaction of coating compositions inherently and with the surface of a substrate. All such factors capable of affecting the chemistry and desired functionality within a coating including antimicrobial or therapeutic functionality.

5. The process provides for the adherence of a wide range of materials including those that would not ordinarily form an adhered coating by ordinary spraying or painting applications: i.e. polymers and ceramics that do not have the chemical functionality to react inherently with each other or a substrate if simply painted or sprayed onto a surface at ordinary temperatures.

The adhered coating at the surface of substrates may be subsequently altered by further treatments so as to augment the chemical and physical nature of the adhered coating towards specific function. Such treatments include modified shot peening or grit blasting treatments, blasting treatments, etching treatments, precipitation treatments, dissolution treatments or cleaning treatments.

For example hydroxyapatite is currently deposited at implant surfaces by high temperature processes such as plasma spray and thermal sputtering. In such processes, hydroxyapatite particles are partially melted en route to a surface utilizing temperatures in excess of 1200° C. These particles solidify to form a coating on the surface. Such processes result in the partial degradation of the Hydroxyapatite to other calcium phosphates primarily as a result of hydroxyl (structural water) loss. The present application may be advantageously used to coat hydroxyapatite onto a surface without water loss particularly where the liquid phase used in the aerosol is comprised at least in part of water. Active agents may subsequently be absorbed into such hydroxyapatite layers.

In other instances components contained in the coating may be advantageously dissolved out of the coating to tailor its morphology. For example if the antecedent composition and ultimately the coating contain sodium bicarbonate such components may be readily dissolved out of the surface on exposure to mildly acidic or aqueous solution so as to engineer the porosity of the coating for subsequent use. One treatment that may be particularly advantageous where the coating is polymeric is a subsequent bombarding treatment. For example soft plastics not readily adhered to surfaces by current methodologies at ordinary temperatures such as PTFE, low density polyethylene and the like may be readily coated onto a surface by the present process to a desired thickness. Exposure of such surfaces to particulate propelled at the surface may result in the particulate being embedded in the polymer coating. Colloidal metal and other potential active agents may be advantageously embedded in such coatings using grit blasting or shot peening equipment to further augment the coating properties, in the particular case of silver to render it bacteriostatic. Other such polymer coatings may be similarly augmented. The present application is particularly suitable for coating the surfaces of medical implants with a carrier matrix (such as by way of example biodegradable polymers, biocompatible ceramics or combinations thereof). Therapeutic agents (such as by way of example antirestenosis, antithrombosis and antimicrobial drugs) may be incorporated into this coating.

Examples of suitable implants for this technique would include hard-tissue implants, dental and orthopedic, stents, pacemakers, defibrillators, guide wires and catheters. In this arrangement, the implant would be bombarded using commercially available shot or grit while an atomised suspension of carrier matrix is delivered to the surface. A therapeutic agent may subsequently be adsorbed onto the carrier matrix in a subsequent treatment or may alternatively be included as a component in the antecedent composition.

In yet another arrangement, the sol of carrier matrix precursors is by way of example a calcium phosphate gel. Such ceramic sols are normally converted into their crystalline counterparts by prolonged exposure to heat (sintering), undesirable particularly where the desired calcium phosphate is Hydroxyapatite. The current process does not involve prolonged exposure to high temperature to facilitate such sol-gel reactions. As a result active agents may be incorporated in the gel and simultaneously deposited at the surface with the further advantage that the agent is homogenously distributed in the coating.

Where the implant is a stent, the present method may be adapted to deliver a material for absorbing the energy generated by MRI scanning with the abrasive or shot and aerosol. The material for absorbing the energy generated by MRI scanning is suitably suspended in the aerosol liquid.

The invention claimed is:

1. A method of augmenting the composition of at least part of the surface of an article or articles, the method comprising the steps of:

a. providing an apparatus that forms an enclosure proximal to at least that portion of the surface(s) to be augmented wherein the apparatus comprises at least one vibrating component, and wherein the vibrating component operates with at least one of the characteristics selected from the group consisting of a vibrating frequency comprised between 15 and 100 kHz, a vibration amplitude between 0 and 300 μm peak to valley, and a distance between the vibrating surface and the article of between 1 and 300 mm, b. providing bombarding particles within the confines of the enclosure, c. providing a surface augmentation material within a liquid precursor, and atomizing the liquid precursor and providing the atomised liquid precursor in the enclosure, d. causing the vibrating component to vibrate at an ultrasonic frequencies such that energy is imparted to the bombarding particles causing the bombarding particles to impact the surface(s) concomitant with the presence of the surface augmentation material.

2. The method of claim 1, wherein augmenting the surface of the article(s) further comprises a step selected from the group of steps consisting of:

incorporating the surface augmentation material into the surface; and coating the surface augmentation material onto the surface.

3. The method of claim 1, wherein the bombarding particles are shot, grit or combinations thereof.

4. The method of claim 1 wherein the temperature inside the chamber is maintained below 150° C.

5. The method according to claim 1, wherein the surface augmentation material is provided as a laminar layer or component of the bombarding particles.

6. The method of claim 1, wherein the surface augmentation material is provided through at least one inlet into the enclosure.

7. The method of claim 6, wherein the inlet is provided in the vibrating component(s) open to the enclosure, and wherein the at least one inlet is a nozzle assembly directed into the enclosure.

8. The method of claim 1, wherein the atomizing is produced by one or more of the following: Bernoulli atomizers, pressure atomisers, two-fluid atomisers, ultrasonic atomisers, modified spray dryers, modified spray coaters, airbrushes, electro spray atomisers, coaxial nozzle assemblies, and coaxial nozzle assemblies operating on the gas lens principle.

9. The method of claim 1, wherein the step of atomization comprises the use of a gas stream in atomizing the liquid precursor or delivering the atomized liquid precursor to the enclosure.

10. The method of claim 9, wherein the gas(es) used within the gas stream are oxidising, and wherein the gas(es) used within the gas stream are free of oxygen.

11. The method of claim 9 wherein the gas(es) comprise one or more of the following:

nitrogenous gases including ammonia and nitrogen inert gases including helium and argon carbonaceous gas including carbon monoxide, carbon dioxide and hydrocarbons sulfurous gases including sulfur monoxide, sulfur dioxide and sulfur trioxide halogen containing gases hydrogen gas.

12. The method of claim 11 wherein the surface of the article to be augmented comprises a metal and the gas(es) react with the surface to form nitrides, carbides, sulphides, halides, hydrides or combinations thereof.

13. An ultrasonic peening apparatus comprising:

a) an enclosure for receiving at least a part of an article, b) a vibrating component for imparting energy to bombarding particles, wherein the vibrating component operates with at least one of the characteristics selected from the group consisting of a vibrating frequency comprised between 15 and 100 kHz, a vibration amplitude between 0 and 300 μm peak to valley, and a distance between the vibrating surface and the article of between 1 and 300 mm, c) an aerosol generator for introducing surface augmentation material as an aerosol within the enclosure.

14. An apparatus according to claim 13, wherein the aerosol is introduced through an inlet provided in a surface of the vibrating component(s) open to the enclosure.

15. An apparatus according to claim 14, wherein the at least one inlet is a nozzle assembly directed into the enclosure.

16. An apparatus according to claim 15, wherein the aerosol generator comprises one or more of the following: Bernoulli atomizers, pressure atomisers, two-fluid atomisers, ultrasonic atomisers, modified spray dryers, modified spray coaters, airbrushes, electro spray atomisers, coaxial nozzle assemblies, and coaxial nozzle assemblies operating on the gas lens principle.

17. An apparatus according to claim 16, wherein the vibrating component is a sonotrode.

18. A method of augmenting the composition of at least part of the surface of an article or articles, the method comprising the steps of:

a. providing an apparatus that forms an enclosure proximal to at least that portion of the surface(s) to be augmented wherein the apparatus comprises at least one vibrating component, b. providing bombarding particles within the confines of the enclosure, wherein the bombarding particles have at least one metric selected from the group consisting of a diameter between 0.1 and 10 mm, a material density between 0.1 $g/cm^3$ and 25 $g/cm^3$, and a volume ratio between the bombarding particles and chamber of less than 50%, c. providing a surface augmentation material within a liquid precursor, and atomizing the liquid precursor and providing the atomised liquid precursor in the enclosure, d. causing the vibrating component to vibrate at an ultrasonic frequencies such that energy is imparted to the bombarding particles causing the bombarding particles to impact the surface(s) concomitant with the presence of the surface augmentation material.

* * * * *